United States Patent [19]

Jensen

[11] Patent Number: 5,026,173

[45] Date of Patent: Jun. 25, 1991

[54] BLOCK-SHAPED BAG WITH A HANDLE AND A METHOD OF PRODUCING SUCH BAG

[75] Inventor: Jorn B. Jensen, Hovedgaard, Denmark

[73] Assignee: Schur Plastic A/S, Vejle, Denmark

[21] Appl. No.: 200,978

[22] Filed: Jun. 1, 1988

[30] Foreign Application Priority Data

Jun. 1, 1987 [DK] Denmark ..... 2789/87

[51] Int. Cl.[5] ..... B65D 33/08

[52] U.S. Cl. ..... 383/10; 53/413; 493/210; 493/226

[58] Field of Search ..... 383/10, 21; 493/210, 493/226, 926; 53/413

[56] References Cited

U.S. PATENT DOCUMENTS

| | | | |
|---|---|---|---|
| 3,208,492 | 9/1965 | Braithwaite | 383/21 |
| 3,240,420 | 3/1966 | Membrino | 383/10 |
| 3,514,033 | 5/1970 | Goodwin | 383/21 |
| 3,756,503 | 9/1973 | Paige | 383/21 |
| 4,252,269 | 2/1981 | Peppiatt | 383/21 |

FOREIGN PATENT DOCUMENTS

| | | | |
|---|---|---|---|
| 925059 | 4/1973 | Canada | 383/21 |

*Primary Examiner*—Stephen P. Garbe

*Attorney, Agent, or Firm*—Antonelli, Terry, Stout & Kraus

[57] ABSTRACT

Large size packagings of napkins, paper rolls, quilts etc. normally appear as tight plastic sheet packings of a block-like shape. As a carrier handle is used a strong strip of sheet material which extends across a side panel of the packing, what is disadvantageous for the visual impression of the packing. A carrier handle cannot be formed direct in the packing sheet, as the packing will then no longer be dust proof. A handle is formed wherein inside the handle area, a barrier layer is provided in order to make the packing dust proof. Preferably a carrier handle strip portion is prepared between easily breakable weakening lines, whereby the handle panel of the packing may show a high quality stamp regardless of the handle.

7 Claims, 2 Drawing Sheets

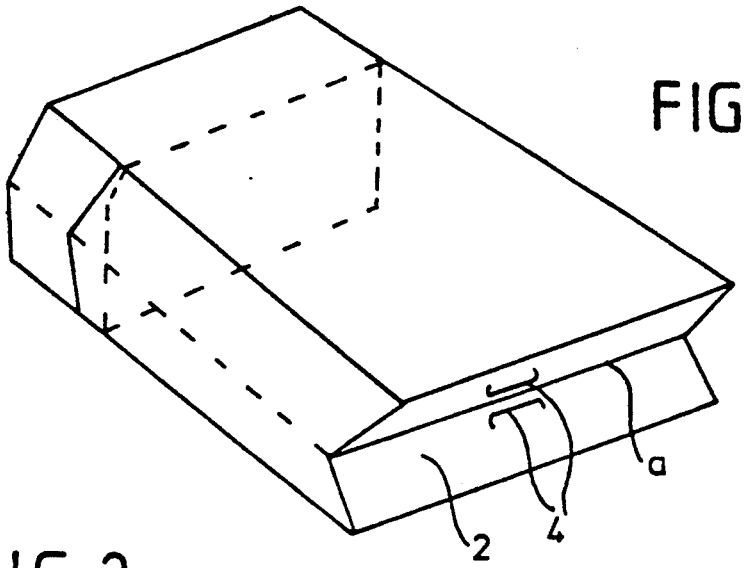
FIG.1
FIG.2
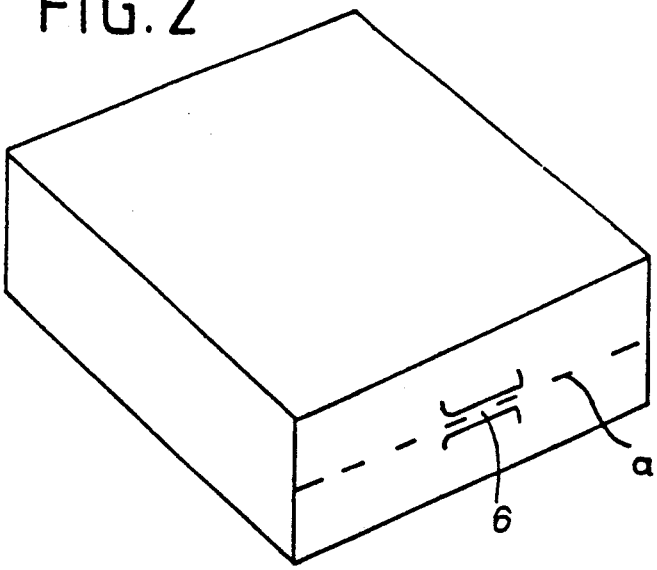
FIG.3
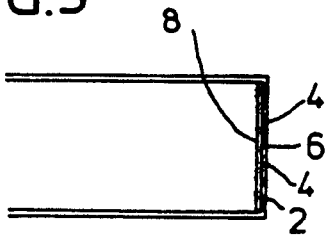
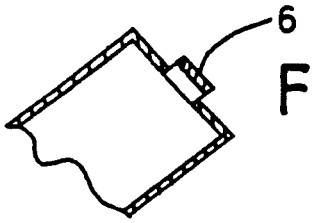
FIG.4
FIG.5
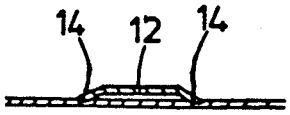
FIG.6
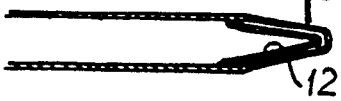
FIG.7
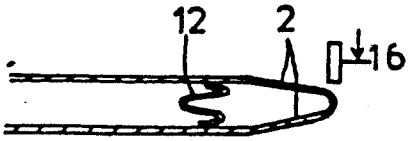
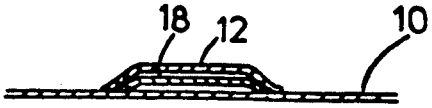
FIG.8
FIG.9
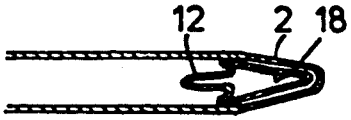

BLOCK-SHAPED BAG WITH A HANDLE AND A METHOD OF PRODUCING SUCH BAG

BACKGROUND OF THE INVENTION

The present invention relates to a bag of a plastic sheet and method of making the same wherein the bag is of a type which, in a distended condition, has the shape of a block, with the bag having a carrying grip formed in or of sheet portions which extend along a flat area of the side of the bag, preferably a large sized bag.

Small packages consisting of such a bag filled with goods such as, for example, napkins, need no handle and packages which are of similar type but larger can be made with a handle corresponding to that of conventional carrying bags, namely, with a handle formed at an upwardly projecting sheet portion extending from the otherwise tightly closed top side of the package.

For various reasons, a bag designed of the aforementioned type has been found unsuited for very large bags, the handle of which being usually formed in or by a heavy cover sheet which extends all over a side panel of the package and is welded or glued to edge areas thereof. In the case of large bags, the side panel can appropriately be the bottom of the bag which, in production of the bag blanks, are reasonably easily provided with such an externally added sheet of suitable shape for forming a flat handle. Upon an introduction of the goods into the bag, the mouth opening thereof may be tightly closed by, preferably, welding, for forming a top side which makes whole contact with the goods, with the top side becoming, in practice, the bottom side of the package when the customer carries the package by the bottom side handle.

It is a well-known fact that from a business point of view it is of utmost importance that packages of the present type are provided with a high quality stamp, which must be performed with reversed orientation on the bag blank, as in effect the bottom side of the package, for example the top side of the blank, is the only one which may be without stamp, whereas it is even particularly important that the top side of the package, for example, the bottom panel of the blank, carries stamp of high quality, this side being the one which is visible to the customer when the packages are displayed in piles in the shops, as the handle most practically should face the customer, so that it can be used already when the package is taken down from the pile.

Thus, the above mentioned prior art packages provide the desired outer shape, for example a distinct box or block shape with smooth surfaces on all sides, as well as a complete confinement of the goods in a sealed, dust proof manner and a reasonably usable handle. However left the considerable problem that the handle sheet, even when formed with large cut outs for forming the carry grip, covers in any case some of the important stamp area just at the side face in question of the package. In practice it is hardly possible to provide the handle sheet with stamp to compensate for the covered area of the surface of the package, in a reasonably advantageous manner. One could make a virtue of necessity by using, for example a vividly colored handle sheet, but in most cases it is preferred to use transparent sheet for this purpose so that the stamp on the basic sheet becomes visible. This, however, is no ideal solution either, as the transparent sheet is not at all totally invisible, so that the stamp on the basic sheet is presented with some distortion of the visual picture.

The object of the invention is to provide a bag of the type referred to which maintains the above mentioned advantages of the prior art packages and which furthermore shows the additional advantage that the stamp on the handle side is not blurred or covered by overlying sheet parts.

This object is achieved in that the bag of the present invention includes a carrying strip portion which is formed directly in the carry grip sides and consists of a material positioned between carry grip apertures or easily breakable weakening lines. An additional imperforative sheet layer is placed within the carry grip side, with the edges of the layer being connected to the carry grip side outside the apertures or weakening lines.

According to the present invention, the weakening lines, required for forming an intermediate carry strip portion, may be formed in a practically invisible manner on the handle side so that this side can present its stamp to the customer without any visual distortion. The visual picture of the side in question will certainly suffer considerable damage, when thereafter the customer makes use of the handle, which means that the customer breaks the weakening lines and grasps the handle strip portion, which then of course will be deformed. However, at this point the customer has made his choice and then it will be of no real significance that the visual picture of the face is distorted. In the area in question there will normally be no stamp of a kind which can later e significant to the customer, such as directions for use or other information.

Normally forming of the handle defining weakening lines in the very bag material has not been found tolerable due to the leakage in the package caused thereby, but according to the invention this solution is fully acceptable, when an internally mounted piece of sheet provides the requisite tightness.

Another scruple could be caused by the fact that a carry strip which is formed of the very bag material may be too weak or require a bag sheet which on the whole is stronger than required for the actual packaging task. However, in cases where a suitable bag sheet is too weak to form also the carry strip, the invention provides the additional possibility of mounting inside of the handle side not only imperforate sheet layer, but also an additional layer immediately behind the handle side which layer may be formed with a carry grip area reinforcing the handle in the bag material itself.

In accordance with the method of the present invention, a sheet web is formed with the carry grip apertures or weakening lines along a strip zone intended to form the bottom panel of the bag, and the strip zone is covered with a strip of an imperforate sheet which is fastened sealingly to the opposite edge lines of the strip zone at an inner side of the bag material.

The invention shall be described in more details in the following with reference to the accompanying drawing.

BRIEF DESCRIPTION OF THE DRAWINGS

FIGS. 1 and 2 are perspective views of an embodiment of the bag according to the invention in a distended condition, FIGS. 3 and 4 are sectional views of an end portion of the bag shown in FIG. 2, FIGS. 5–7 are sectional views illustrating a method for the production of the sheet blanks employed, FIGS. 8 and 9 are corresponding sectional views illustrating the production of a modified embodiment of the bag.

DETAILED DESCRIPTION

Figure 10:
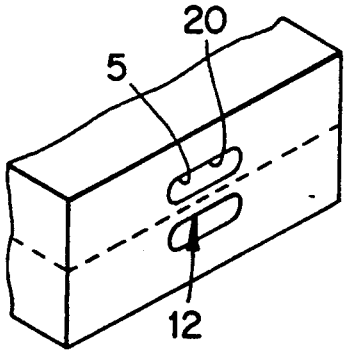
FIG. 10 is a perspective end view of another modification of a bag in accordance with the present invention.

FIG. 1 shows a bag blank under unfolding from a compressed condition, whereby the folded-in bottom side is straightened out. FIG. 2 shows the bag in completely unfolded condition for receiving a blocklike article such as a group of piled-up napkins or sanitary towels. After the introduction of the article the mouth area of the bag is closed in a conventional way by welding, so that the closed mouth face appears as a substantially plane side portion of the package.

The bottom portion 2, forming a carry grip side of the bag, is provided with a pair of weakening lines 4, is a carry grip area of the bag, with the weakening lines for being symmetrical about the middle folding line a and, after straightening out defining an intermediate carry strip portion 6, FIG. 2, which may be used as a carrying handle when the weakening lines 4 have been broken by the fingers. The weakening lines 4 are, in a manner not shown, formed with a few spaced interruptions of quite short length, so that only a gentle pressure is required to break them. In return the carry grip area at and around the weakening lines 4 before the breakthrough will appear as a continuous, plane face which together with the other outer side portions of the package may be provided with a desired stamp without the picture of the stamp being in any way disturbed by the weakening lines 4 as long as these weakening lines 4 remain unbroken.

In FIGS. 3 and 4 a piece of sheet 8 is shown located within the bottom panel or panel 2 and fastened to the edges of the panel 2. The piece of sheet 8 is imperforate, so that the contents of the package are tightly enclosed notwithstanding the perforations at the weakening lines 4. In FIG. 4 the carry strip 6 is shown pulled out into an effective carry position.

With a view toward continuous production of the bag blanks a narrow strip of sheet 12 may, as shown in FIG. 5, be applied to the central portion of a sheet web 10 and fastened along its edges 14, by, for example hot-air welding. The sheet is folded as shown in FIG. 6 by using a conventional folding device, whereupon air is blown into the region between the web sheet 10 and the narrow strip of sheet 12 so that the narrow strip of sheet 12 is blown or folded to the rear from the outer folding edge of the web sheet 10 which is shown in FIG. 7. Thereafter the weakening lines 4 can be produced in the folded panel 2 by a punching tool 16, and when later the blank is erected, the panel portions 2 and 12 will be straightened out to form close to each other positional wall portions.

In the course of the production of the bag package an extra layer of sheet 18, equal in width to the narrow strip of sheet 12, can be applied between the sheet web 10 and narrow strip of sheet 12 as shown in FIG. 8. As will appear from FIG. 9 this extra layer is folded forward together with the panel portion 2, whereas, the narrow strip of sheet 12 is folded to the rear as before. Thus, punching by the tool 16, FIG. 7, will produce weakening lines 4 also in the extra layer of sheet 18 so that this extra layer 18 will serve to reinforce the handle or intermediate carry strip portion 6. Subsequently the bag web is further treated in the usual way by folding-in of the bottom area and formation of the individual bags by cutting of the web.

Of course it is possible to produce the bag packing in other ways, by, for example, making the weakening lines 4 on the unfolded, prestamped sheet 10 and thereafter adding the barrier layer or narrow strip of sheet 12 before folding the bag web.

There is nothing to prevent formation of more weakening lines 4, 6 on the same panel portion of the packing. For reasons of production technique it is advantageous to use just the bottom panel of the bag packing for the purpose, but in principle any of the side faces of the packing can be selected.

It should be noted that instead of the weakening lines 4 the panel in question might be provided with real punched grip apertures 5 (FIG. 10) on each side of the intermediate carry strip portion 6 which, of course requires a corresponding adaption of the stamp. By using the extra reinforcing layer of sheet 18 and by performing the punching with a melting tool the edges of the apertures 5 may be simultaneously welded to the edges of the corresponding apertures in the extra layer of sheet 18 along weld edges 20. Of course, the punching should take place with the web in a spread-out condition, FIG. 8, after the extra layer of sheet 18 has been applied, but before the barrier layer or narrow strip of sheet 12 is applied. By this welding together a further reinforcement of the handle area is obtained.

I claim:

1. A bag of plastic sheet and of the type which in a distended condition has the shape of a block, said bag having a carry grip side with a flat carry grip area in which a carry strip portion of the plastic sheet is located between one of carry grip apertures or easily breakable weakening lines in the carry grip side, an additional sheet layer is located adjacent and inside of the carry grip side and is connected to the carry grip side outside of said carrying grip area, and in that said additional layer is imperforate.

2. A bag according to claim 1, characterized in that an intermediate layer formed from a sheet is provided between the carrying grip area and said additional sheet layer.

3. A bag according to claim 1, characterized in that the carry grip apertures or weakening lines are symmetrical about a middle line of the carry grip side.

4. A method of producing a plastic sheet bag having a carry grip side with a flat carry grip area, in which a carry strip portion of the plastic sheet is formed between one of opposed carry grip apertures or easily breakable weakening lines in the carry grip side, the method comprising the steps of forming a sheet web with said carry strip portion located in a sheet web zone intended to form the bottom panel of the bag, covering said sheet web zone with a strip of an imperforate sheet, and sealingly fastening the imperforate sheet at an inside of the bag in the web sheet zone.

5. A method according to claim 4, wherein said strip of sheet is applied to and welded to the sheet web in a spread-out condition of the latter, after which the web is folded inwardly about the longitudinal middle line of said strip zone with said strip of sheet folded inwardly away from the folding edge of the web, whereupon the carry grip apertures or the weakening lines are formed by cutting-through of web portions folded together in said strip zone.

6. A method according to claim 4, wherein a second sheet strip is applied and fastened between the sheet web and said first sheet strip, in which second sheet strip a carry grip area is formed opposite to the corresponding carry strip portion of the outer sheet.

7. A method according to claim 6, wherein the sheet web and said second sheet strip are welded together along edges of the carry grip apertures or weakening lines.

* * * * *